United States Patent [19]

Clark

[11] Patent Number: 4,718,379

[45] Date of Patent: Jan. 12, 1988

[54] ROCKER ARM PIVOT ASSEMBLY

[75] Inventor: David P. Clark, Battle Creek, Mich.

[73] Assignee: Eaton Corporation, Cleveland, Ohio

[21] Appl. No.: 866,654

[22] Filed: May 27, 1986

[51] Int. Cl.[4] ..... F01L 1/18

[52] U.S. Cl. ..... 123/90.39; 123/90.41; 384/2

[58] Field of Search ..... 123/90.41, 90.44, 90.39; 308/2 R; 384/2

[56] References Cited

U.S. PATENT DOCUMENTS

| | | | |
|---|---|---|---|
| 2,123,681 | 7/1938 | Willgoos | 123/90.33 |
| 2,572,968 | 3/1947 | Bachle . | |
| 3,251,350 | 5/1966 | Thompson . | |
| 4,314,732 | 2/1982 | Murphy | 123/90.41 |
| 4,497,307 | 2/1985 | Paar et al. | 123/90.33 |
| 4,628,874 | 12/1986 | Barlow | 123/90.39 |

FOREIGN PATENT DOCUMENTS

| | | | |
|---|---|---|---|
| 130497 | 6/1932 | Fed. Rep. of Germany | 123/90.39 |
| 966302 | 10/1950 | France | 123/90.39 |

*Primary Examiner*—Craig R. Feinberg
*Assistant Examiner*—David A. Okonsky
*Attorney, Agent, or Firm*—D. A. Rowe; F. M. Sajovec

[57] ABSTRACT

A retrofit roller bearing pivot assembly for a rocker arm of an internal combustion engine valve gear. A mounting stud or post threaded on one end for attachment to the engine has a fulcrum member received thereover and registered against a head formed thereon with transversely extending oppositely disposed cylindrical bearing surfaces. A roller bearing race is received on each of the bearing surfaces and a semi-cylindrical sleeve member has the post received therethrough and has concave portions on opposite ends thereof journalled on the fulcrum bearing surfacers. The sleeve is retained against the bearings by a spring clip received over the end of the post and engaging ledges on the sleeve. The fulcrum is retained in registration on the post by a contoured supporting spacer held in place by a suitable snap ring received over the post threads. The assembly is sized to drop between the side wall of a cupped rocker arm.

8 Claims, 5 Drawing Figures

ROCKER ARM PIVOT ASSEMBLY

BACKGROUND OF THE INVENTION

The present invention relates to combustion chamber valve gear for an internal combustion engine. In particular, the invention relates to engine valve gear of the type having an overhead rocker arm pivoted about a fulcrum disposed intermediate the end of the rocker arm. More particularly, the invention relates to engine valve gear having rocker arms pivoted intermediate the ends about a fulcrum mounted on a post anchored to the engine. Such a post mounted rocker amrs for engine valve gear are usually formed in a generally cupped shaped configuration with the fulcrum member received over the post and having pivot surfaces formed thereof which slidably engage corresponding pivot surfaces formed on the rocker arm in the region surrounding the aperture, wherein the rocker arm is received over the post.

Engine valve gear having rocker arms pivoted about a fulcrum of the above described type have found widespread usage in automotive engines of the type having push-rod actuated valve gear; and, in particular, in automotive engines having a v-type configuration. However, in valve gear having rocker arms pivoted about a post mounted fulcrum, it has been found that a substantial amount of friction is generated in the sliding of the rocker arm about the fulcrum, and this type of pivot requires constant lubrication in addition to consuming engine power in the friction forces.

It has, therefore, been desired to find a way of providing a fulcrum for the pivotal motion of an engine valve gear rocker arm mounted over a post in a manner which would reduce the frictional forces generated in the pivot. It has been proposed to provide roller bearings in the fulcrum or pivot of an engine valve gear rocker arm to reduce friction. However, in order to employ roller bearings in engine valve gear rocker arms of the type mounted for over a post for pivotal motion, it has been necessary to completely redesign the rocker arm and the fulcrum members attached to the post. Thus, it has long been desired to find a way or means of providing an easily adaptable roller bearing pivot or fulcrum for a post mounted engine valve gear rocker arm. It has particularly been desired to provide a way or means of retrofitting a roller bearing equipped pivot or fulcrum into existing cup-shaped engine valve gear rocker arm without requiring alteration of the existing rocker arms or reworking of the mounting post location or attachment to the engine.

SUMMARY OF THE INVENTION

The present invention provides a unique means or way of retrofitting with roller bearings, the fulcrum or pivot for engine valve gear having cup-shaped rocker arms pivoted about a semi-cylindrical fulcrum mounted over an upstanding post on the engine. The present invention provides a "drop-in" assembly for replacement of the existing semi-cylindrical fulcrum member received over the mounting post.

The present invention comprises an assembly of a transverse fulcrum member received over a mounting post and registered thereon, with the post having the opposite end threaded for attachment to the engine. A roller bearing race is received over each end of the fulcrum member. An apertured semi-cylindrical sleeve member is received over the post and has the inner surface thereof, at each end, registered over the outer race of one of the roller bearings and a contoured spacer is received over the threaded end of the post, and registered against the transverse fulcrum member for spacing the assembly at the proper height on the post. The spacer is retained on the post for shipment by a suitable retainer, such as a wire or plastic clip. The invention thus provides a novel retrofit fulcrum assembly for installation in an existing engine valve gear having a post mounted cupped rocker arm, which provides roller bearing pivot for the rocker arm, and yet requires no rework of the existing engine parts.

DETAILED DESCRIPTION

Figure 1:
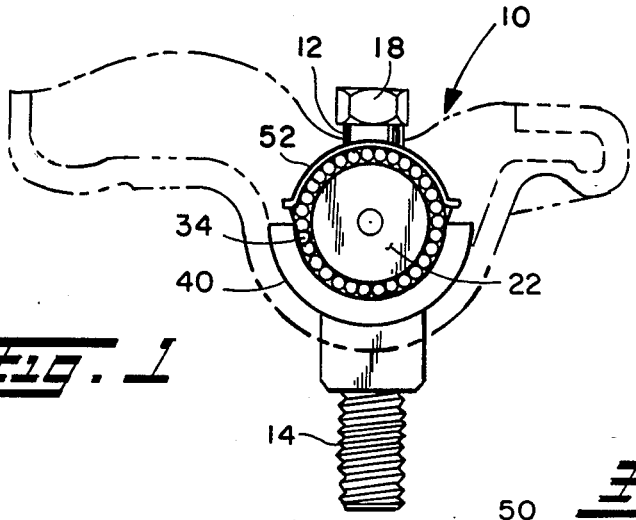
FIG. 1 is an end view of the fulcrum assembly of the present invention.
Figure 2:
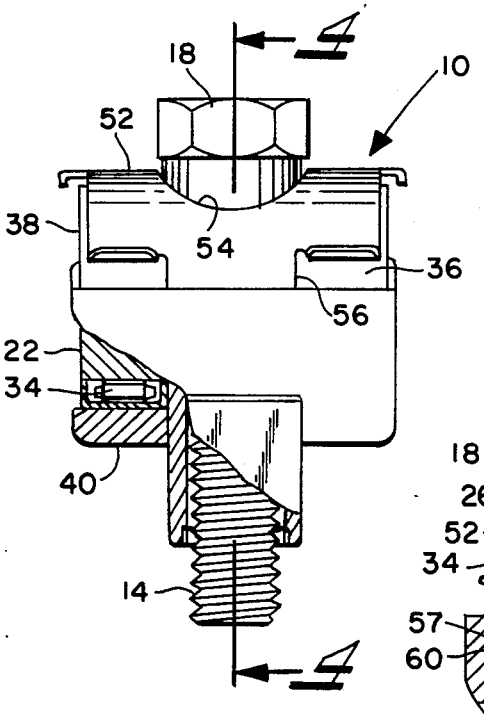
FIG. 2 is a side view of the assembly of FIG. 1.
Figure 3:
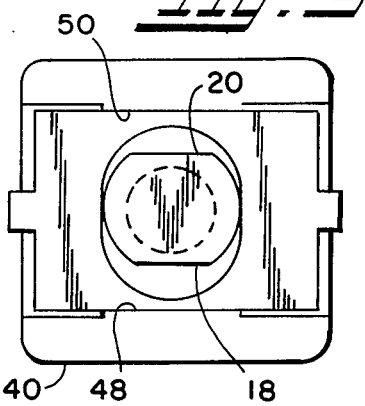
FIG. 3 is a top view of the assembly of FIG. 1.
Figure 5:
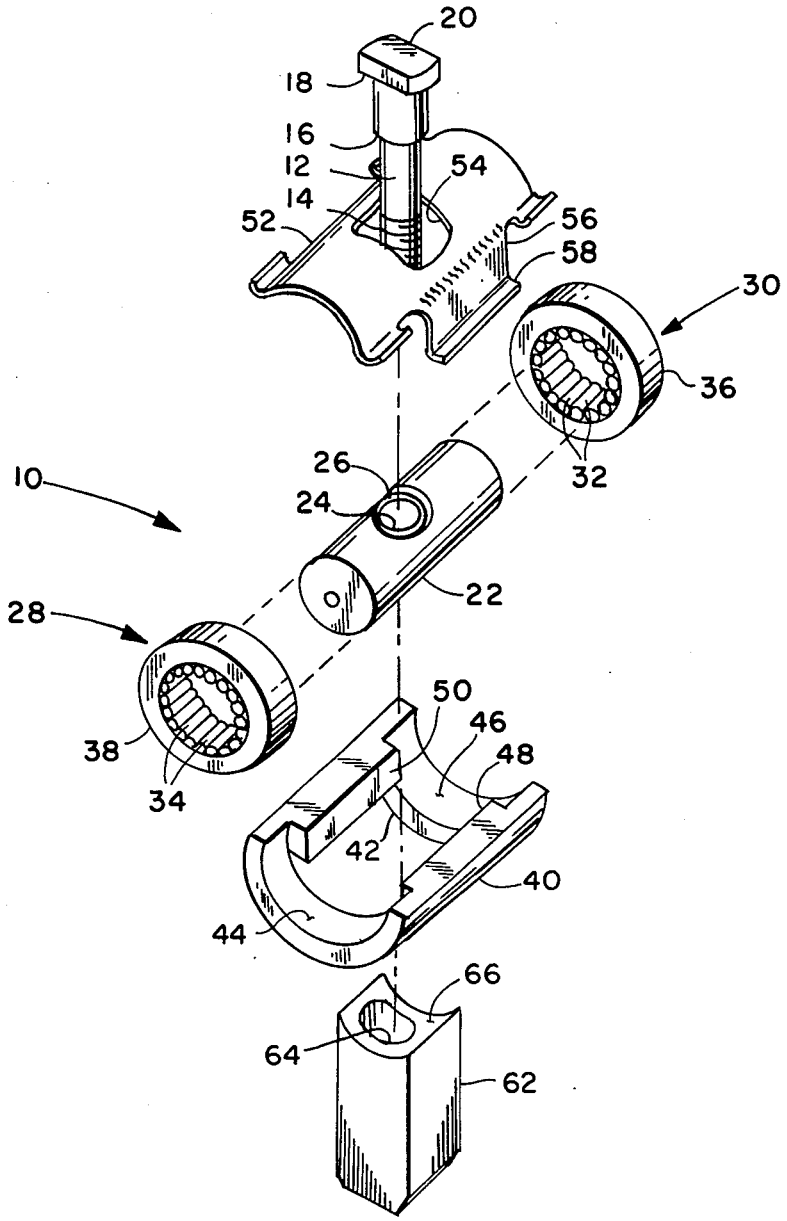

Referring now to FIGS. 1 and 5, the fulcrum assembly of the present invention is indicated generally at 10, wherein the mounting post or stud 12 has a threaded end 14 adapted for attachment to existing post mounting threads in an engine (not shown), and post 12 further has an annular shoulder 16 provided adjacent the end, thereof, remote from the threads 14. The upper end of post 12 has suitable torque receiving surfaces provided thereon, such as the pair of flats 18, 20. It will be understood, however, that any suitable torque receiving expedient may be employed in place of the flats 18, 20, as for example, a hexagonal head or polygonal socket formed in the end of the post for receiving a suitable torque applying tool therein.

A generally cylindrical fulcrum member 22 has a transverse bore 24, provided therethrough, which is received over post 12. The fulcrum 22 has a counterbore provided therein, which forms the annular shoulder 26, which is registered against the shoulder 16 on the post.

The diameter of the fulcrum at each of its ends is sized to have received thereover a roller bearing race indicated generally at 28, 30, which race has a plurality of needles 32, 34 encased in an outer race or shell indicated by reference numerals 36, 38. The needles 32, 34 are journalled directly on the outer periphery of the ends or trunnions of the fulcrum member 22.

With reference to FIGS. 1–5, a sleeve member 40, has a semi-cylindrical shell configuration, with a centrally disposed cut-out or aperture 42 formed through the wall thereof. The end regions of the inner surface of the sleeve 40, are configured respectively at 44, 46 to provide surfaces which conform to and are registered over respectively, the outer periphery of the bearing shells 38, 36. The longitudinal edges of the semi-cylindrical shell 40, have formed thereon, lug or rib 48, 50, which extend inwardly of the shall a distance approximately one-fourth to one-half the thickness of the shell. Each of the ribs forms one of the opposite parallel sides of the aperture 42 and has adapted for engagement therewith.

A retaining clip 52, having a generally semi-cylindrical shell configuration, has a clearance aperture provided centrally therein, which is received over post 12 with the semi-cylindrical end of the clip registering over the outer periphery of the bearing shells 38, 36. The clip 52 has a tab extending downwardly from each longitudinal edge thereof in the central region, one of which is illustrated at 56 in FIGS. 2, 4 and 5. The clips each have an outwardly extending flange, provided on the free end thereof, each of which flanges engages respectively the undersurface of one of the lugs 48, 50 for retaining the sleeve 40 in contact with the bearing shells 36, 38.

Figure 4:
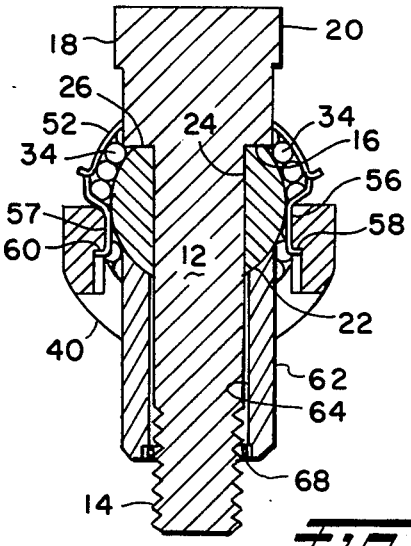
FIG. 4 is a section view taken along section indicating lines 4—4 of FIG. 2; and, FIG. 5 is an exploded view of the embodiment of FIG. 1.

A spacer member 62 has a central bore 64 formed therethrough, which has the threaded end of post 12 received therethrough. Referring to FIG. 5, the upper end of the spacer 62 is received through aperture 42 in the sleeve and passes between lugs 48, 50, and has the upper end thereof contoured to conform to and register against the outer surface of the central region of fulcrum member 22. Spacer 62 is retained in position on the post 12 during shipment of the assembly by a suitable wire or plastic ring 68, as shown in FIG. 4. The ring 68 is required only for shipment to maintain the spacer in place on the post 12, and may be removed prior to installation of the assembly in an engine. In the presently preferred practice, the clip is not removed.

The present invention thus provides a fulcrum assembly for a rocker arm of an engine valve gear and provides for roller bearings at the rocker arm pivot thereof in a form readily retrofitted into an existing engine valve gear.

Although the invention has been described hereinabove with respect to the presently preferred practice and the illustrated embodiments, it will be understood that the invention is capable of variation and modification and is limited only by the following claims.

I claim:

1. A rocker arm pivot assembly for valve gear of an engine, said assembly comprising:

(a) an elongated post member having means for attachment thereto provided on one end thereof and a reaction surface disposed distally of said attachment means and extending in a direction to resist loads applied thereto generally in the direction of elongation of said post;

(b) a fulcrum member having said post member received therethrough, said fulcrum registered on one side thereof against said reaction surface and having a pair of journalling surfaces thereon extending transversely of said post in opposing directions;

(c) rolling bearing means received on each of said journalling surfaces of said fulcrum member;

(d) a semi-cylindrical sleeve member with said post member received therethrough, said sleeve member having a pair of spaced journalling surfaces provided on the inner periphery thereof, said surfaces each contacting one of said bearing means;

(e) flexible retaining means with said post member received therethrough, said retaining means including journalling surfaces formed thereon engageable with said bearing means, and means formed thereon engaging said sleeve whereby said bearing means are maintained in position between said sleeve and said retaining means; and (f) spacer means operative to maintain said fulcrum member in contact with said post reaction surface upon attachment of said post member to an engine.

2. The assembly defined in claim 1, wherein said rolling bearing means includes needle bearings.

3. The assembly defined in claim 1, wherein said post member has attaching means comprising thread and said post has torque transmitting surfaces provided on the end opposite said threads, said surfaces adapted for rotating said post to engage said threads.

4. The assembly defined in claim 1, wherein said retaining means comprises a spring clip engaging shouldered portions of said sleeve member on opposite sides thereof.

5. The assembly defined in claim 1, wherein said retaining means comprises an arcuately shaped spring clip having the ends thereof each engaging a ledge on opposite sides of said sleeve means.

6. The assembly defined in claim 1, wherein said fulcrum member comprises a generally cylindrical shaft having a central cross-hole with said post received therein.

7. The assembly defined in claim 1, wherein said fulcrum member comprises a generally cylindrical shaft and said spacer means comprises a tubular member having a concave surface formed on one end thereof, said concave surface contacting the cylindrical surface of said fulcrum member.

8. The assembly defined in claim 1, further comprising clip means for retaining said spacer means in position on said post means.

* * * * *